United States Patent [19]

Colon, Jr.

[11] 4,407,027

[45] Oct. 4, 1983

[54] POOL-COVER APPARATUS AND METHOD

[76] Inventor: George M. Colon, Jr., 32072 Sea Island Dr., Laguna Niguel, Calif. 92677

[21] Appl. No.: 291,512

[22] Filed: Aug. 10, 1981

[51] Int. Cl.[3] ..... E04H 7/02

[52] U.S. Cl. ..... 4/502; 242/86.52; 414/778; 280/43.24; 188/5; 188/382

[58] Field of Search ..... 4/500, 502; 242/86.52; 414/778, 911; 280/43.24; 188/5, 382

[56] References Cited

U.S. PATENT DOCUMENTS

| | | | |
|---|---|---|---|
| 951,718 | 3/1910 | Arnsdorff | 188/32 |
| 1,299,512 | 4/1919 | Seidel | 188/32 |
| 2,489,390 | 11/1949 | Sterns | 414/778 |
| 2,771,162 | 4/1952 | Marsh | 188/32 |
| 2,858,906 | 9/1956 | Minick | 188/32 |
| 3,070,811 | 6/1960 | Bender | 4/172 |
| 3,091,414 | 6/1963 | Patnaude | 242/86.52 |
| 3,684,060 | 8/1972 | Waddle | 188/36 |
| 3,747,132 | 7/1973 | Foster | 4/502 |
| 3,876,173 | 4/1975 | Cline | 248/119 R |
| 3,885,255 | 5/1975 | Vorbach et al. | 4/502 |
| 4,001,900 | 1/1977 | Lamb | 4/502 |
| 4,179,080 | 12/1979 | Patnaude | 242/86.52 |
| 4,195,370 | 4/1980 | Budd | 4/502 |
| 4,195,370 | 4/1980 | Budd | 4/172.14 |
| 4,243,468 | 1/1981 | Boyd | 242/86.52 X |
| 4,324,370 | 4/1982 | Guard et al. | 4/502 |

FOREIGN PATENT DOCUMENTS

| | | | |
|---|---|---|---|
| 46358 | 12/1979 | Canada . | |
| 645153 | 10/1950 | United Kingdom | 414/778 |

OTHER PUBLICATIONS

"The Sealed Air Solar Reel System–Assembly & Installation Instructions", 3 pp.

"The Eazy-Roller", of Rocky's Eazy-Roller of B.C. Leisure Products Ltd., 1373 Main St., No. Vancouver, B.C., Canada.

Newspaper Clipping from the Los Angeles Times regarding a reel from "Pool Cover Supply", Apr. Special.

*Primary Examiner*—Charles E. Phillips

[57] ABSTRACT

In the first embodiment of the apparatus, each end frame of the apparatus has one position at which wheels engage the decking surrounding the pool, and another position at which a braking region engages such deck. In accordance with the method, the operator rolls the apparatus to a desired location when each end frame is in the first-mentioned position, and then tilts each such end frame to the second-mentioned position. He then pulls the pool cover off of the now-stationary frame. In accordance with a second embodiment, each end frame is circular and operates as a wheel when it is desired to move the apparatus. To achieve braking, one edge region of each such wheel is pivoted to expose a chordal braking area. In accordance with the method relative to the second embodiment, the shifting from the rolling mode to the braking mode is effected when the indicated edge regions are at rotated positions such that they do not engage the decking.

14 Claims, 7 Drawing Figures

POOL-COVER APPARATUS AND METHOD

BACKGROUND OF THE INVENTION

It has long been recognized that covers for swimming pools are frequently so large and bulky that it is impractical to manage them in the absence of some sort of a reel or other apparatus. Accordingly, the prior art has been characterized by large numbers of reels some of which have been stationary, and some movable. At least one manufacturer offers two kinds of reel apparatus, one non-rollably supported on the decking and another movable therealong on wheels, the latter kind also having anchoring means which can be associated with cooperating anchor means in the decking.

Insofar as applicant is aware, there has never been a highly simple, economical, practical reel apparatus, wherein the shifting from the movable mode to the braked mode is effected extremely easily and with a minimum of apparatus, and wherein the braking apparatus is not at all unsightly and does not require association with the decking at a particular anchor region.

SUMMARY OF THE INVENTION

In accordance with one embodiment of the apparatus, each end frame of the pool-cover reel has wheels on one side thereof and a relatively large braking area on another side thereof, the relationship being such that either such one side or such other side may be disposed adjacent the decking by tilting the end frame. In accordance with the method relative to such embodiment, the entire reel apparatus, with pool cover thereon, is rolled from a storage area to a position which preferably straddles one end of the pool, this occurring when the wheeled sides of the end frames are engaged with the decking. Then, the operator tilts each end frame to remove the wheeled side from the decking and cause the braking area to engage the decking. He then unwinds the pool cover from the now-braked reel. To retrieve the pool cover, crank means in the form of hand wheels are turned to roll up the pool cover, this occurring while the reel is in such position that there is no substantial resistance of the pool cover to leaving the water. Then, each frame is tilted back to its position at which the wheels engage the decking, and the entire apparatus is rolled to a storage area.

In accordance with the second embodiment, each end frame is itself a wheel, preferably having an axis the same as that of the rolled-up pool cover. One segment of each end frame is adapted to pivot laterally, when the wheel is in a rotated position such that the segment is not adjacent the decking, thereby exposing a relatively large chordal braking area. The chordal braking area of the wheel is increased, in area, by a braking area of the pivoted-away segment. In accordance with the method, the entire reel apparatus is wheeled into straddling relationship to the pool end, and each segment is pivoted to expose the chordal braking regions, this occurring while each segment is not adjacent the decking. The pool cover is then pulled to operative position and later retrieved by rotating crank means such as hand wheels. Then, each wheel is tilted until the chordal braking regions are not adjacent the decking, following which the segments are pivoted back to their positions forming continuations of the wheel-like end frames. The entire apparatus is then wheeled to a storage region.

DETAILED DESCRIPTION OF THE PREFERRED EMBODIMENTS

The embodiment of FIGS. 1–4 is presently preferred and is the contemplated production model.

Figure 1:
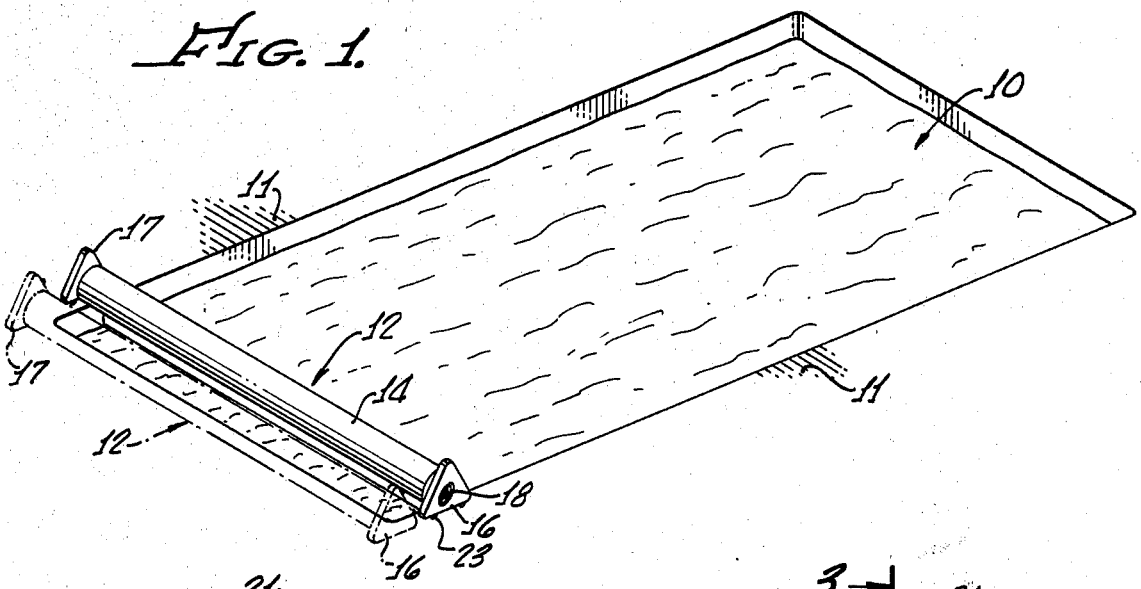
FIG. 1 is an isometric view of a pool having associated therewith a pool-cover apparatus constructed in accordance with a first embodiment of the present apparatus.
Figure 3:
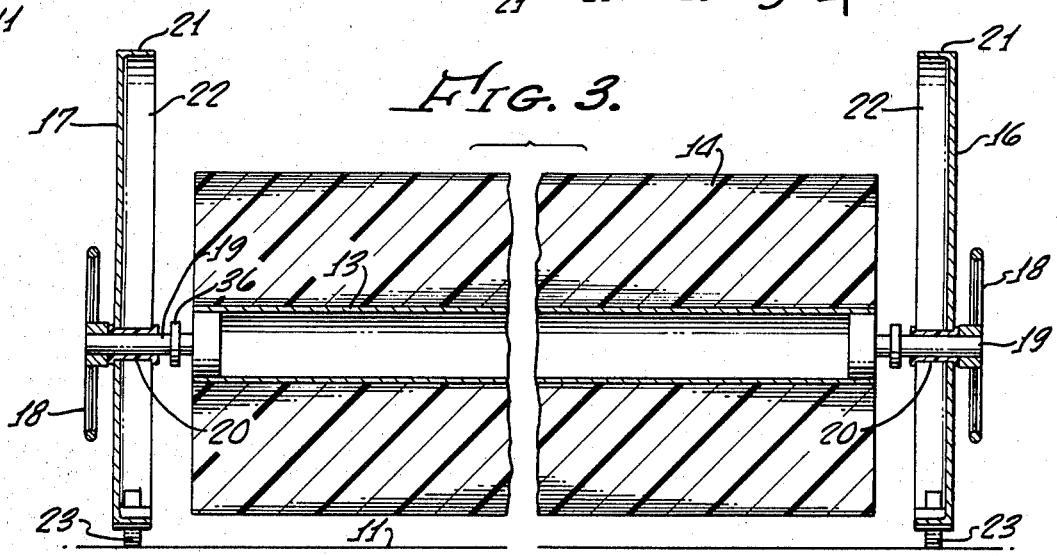
FIG. 3 is a longitudinal sectional view of the apparatus, taken along line 3—3 of FIG. 2.

Referring first to FIG. 1, a swimming pool is shown at 10 and the decking at 11. The pool-cover (reel) apparatus of the first embodiment is indicated generally at 12, being shown in solid lines in rolling condition and in phantom lines in braked condition. The apparatus 12 comprises an elongated roller (spool or spindle) element 13 which is preferably hollow as shown in FIG. 3. Roller 13 is preferably sufficiently long that the apparatus 12 can straddle the pool as shown in FIG. 1. Wound on element 13 is the pool cover 14, being preferably two layers of flexible synthetic resin between which are trapped bubbles of air.

End frames 16 and 17 are mounted at opposite ends of roller 13, and each end frame is tiltable about an axis parallel to that of roller 13. The end frames are disposed generally in planes perpendicular to the axis of roller 13. As shown in FIG. 3, cranks (hand wheels) 18 are disposed on the sides of frames 16 and 17 remote from roller 13, being mounted on stub shafts 19 which extend through bushings or bearings 20 in the frames 16 and 17. At their inner ends, these stub shafts are connected coaxially to roller 13. Thus, turning of either hand wheel 18 rotates roller 13 to roll-up the pool cover 14 when desired. Conversely, when the free end of the pool cover is pulled, the shafts 19 and hand wheels rotate freely.

End frames 16 and 17 are identical to each other, being mirror images about a vertical plane which extends between the end frames longitudinally of the pool. Each is illustrated as being solid and triangular, having rounded corners 21 adapted to operate as rocker or pivot regions. A flange 22 extends inwardly from the main body of each end frame 16 and 17, for two purposes. One such purpose is that the flange 22 on one side of each frame provides a mounting region for wheels 23 adapted to roll on decking 11. Each wheel 23 has an axis perpendicular to the main body of its associated end frame 16 or 17, the axis being at the shafts 24 shown in FIGS. 2 and 4.

Figure 4:
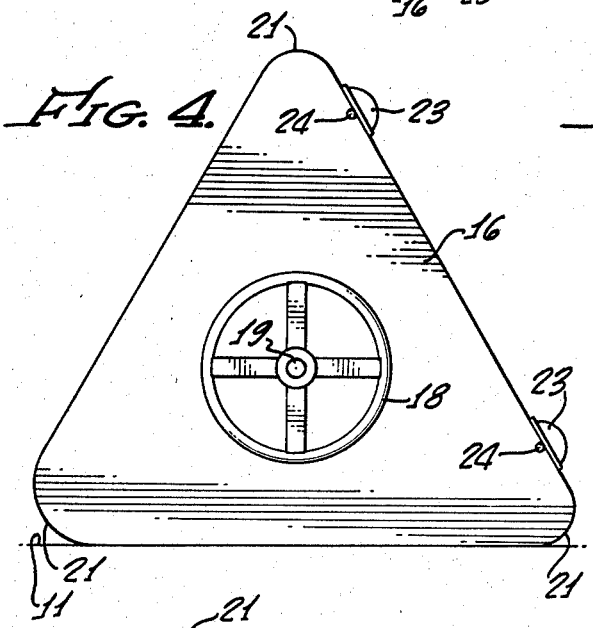
FIG. 4 is an end elevational view corresponding to FIG. 2 but showing an end frame in its braking condition, corresponding to that shown in phantom lines in FIG. 1.

At the remaining two sides of the triangular end frames 16 and 17, flanges 22 do not have any wheels. Instead, such sides serve as (to achieve the other purpose) large-area braking regions adapted to rest directly on decking 11 as shown in FIG. 4. These braking regions are caused to be sufficiently large that, in combination with the weight of the apparatus 12, the apparatus 12 will remain stationary when the operator pulls on the free end of pool cover 14 to unroll the cover.

Preferably, each end frame is an equilateral triange, and the stub shaft 19 is located at the center of such triangle.

Figure 2:
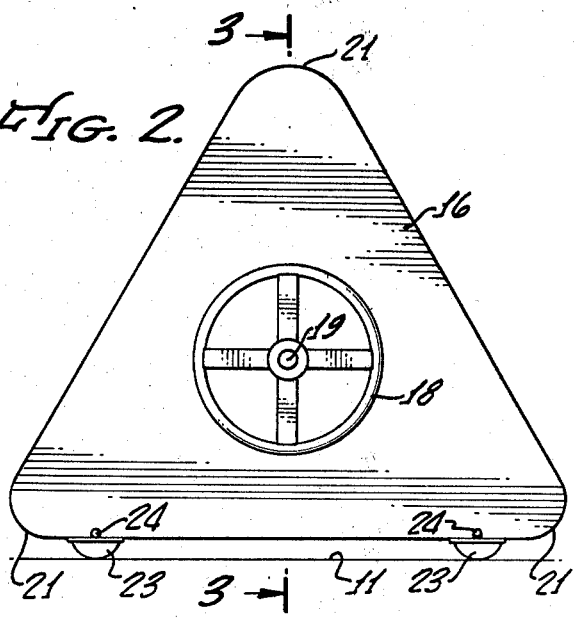
FIG. 2 is an end elevation of the apparatus as viewed from the right in FIG. 1.

In summary, each end frame 16 and 17 has one rotated position—the one shown in FIG. 2 and in solid lines in FIG. 1—at which it rolls on the decking so that the apparatus 12 may be readily moved from a storage region to the end of the pool 10. Each end frame also has another rotated position at which it is not adapted to roll but is, instead, in braked relationship relative to the decking. The braked position is shown in FIG. 4 and in phantom lines in FIG. 1.

In accordance with the method of the first embodiment of the invention, the reel apparatus 12 is stored at any region, preferably relatively remote from pool 10. When it is desired to cover the pool, the operator pushes on the apparatus 12 to roll it to the position shown in solid lines in FIG. 1, the wheeled side of flange 22 then being adjacent the decking so that the wheels 23 roll on the decking to make the transport of the entire apparatus 12 easy.

Then, the operator holds one of the lower corners 21, of end frame 16, either with his foot or with one of his hands. Simultaneously, he pulls on the upper corner 21 to tilt end frame 16 so that one of its braking sides is supported on the decking 11. Thus, for example, to shift from the position of FIG. 2 to that of FIG. 4, the lower-left corner 21 is held while the upper corner 21 is pivoted counterclockwise. During this movement, the lower-left corner (FIG. 2) first engages the decking and then pivots thereon in a rocking motion, about an axis parallel to that of roller 13. It is pointed out that it would have been equally possible to rotate clockwise from the FIG. 2 position, so that the other braking surface would engage the decking 11, operation being equally satisfactory regardless of the direction of tilting of each end frame.

The same operation is repeated relative to the other end frame 17. Then, the apparatus 12 being braked, the operator pulls on the free end of the pool cover 14 (by means of a rope or cord, not shown) and unwinds the pool cover so that it extends to the end of the pool remote from the apparatus, namely the right end as viewed in FIG. 1. The position of the apparatus 12 during the unwinding is caused to be such that the pool cover, preferably, does not engage an end lip of the pool decking. This is because it is not desired that the pool cover rub on the decking, since this would tend to wear out the cover. At the end of the pool-covering operation, the entire pool is covered, preferably by a cover that floats on the surface of the water in the pool.

To retrieve the cover, the operator merely turns one of the hand wheels 18 to rotate roller 13 in such direction as to roll-up the pool cover 14 thereon. Very preferably, this operation is performed when the apparatus 12 is in straddling relationship relative to the pool, and spaced a short distance toward the left end of the pool (as viewed in FIG. 1) so that there is some small region of the pool located on the left side (FIG. 1) of the apparatus 12. This straddling relationship permits the cover to be rolled up in a way which breaks the surface tension or other force tending to cause the cover to remain in contact with the surface of the water. Preferably, the pool cover loops back beneath the apparatus 12, and the hand wheel 18 is turned counterclockwise to rotate the pool cover 14 counterclockwise on the roller 13, all as viewed in FIG. 2.

Then, each end frame 16 and 17 is tilted about one of its corners 22 in a manner the reverse of that described above, so that the wheeled side of flange 21 is adjacent the decking 11 and the wheels 23 are supported on the decking. The entire apparatus is then rolled to a storage area.

Figure 6:
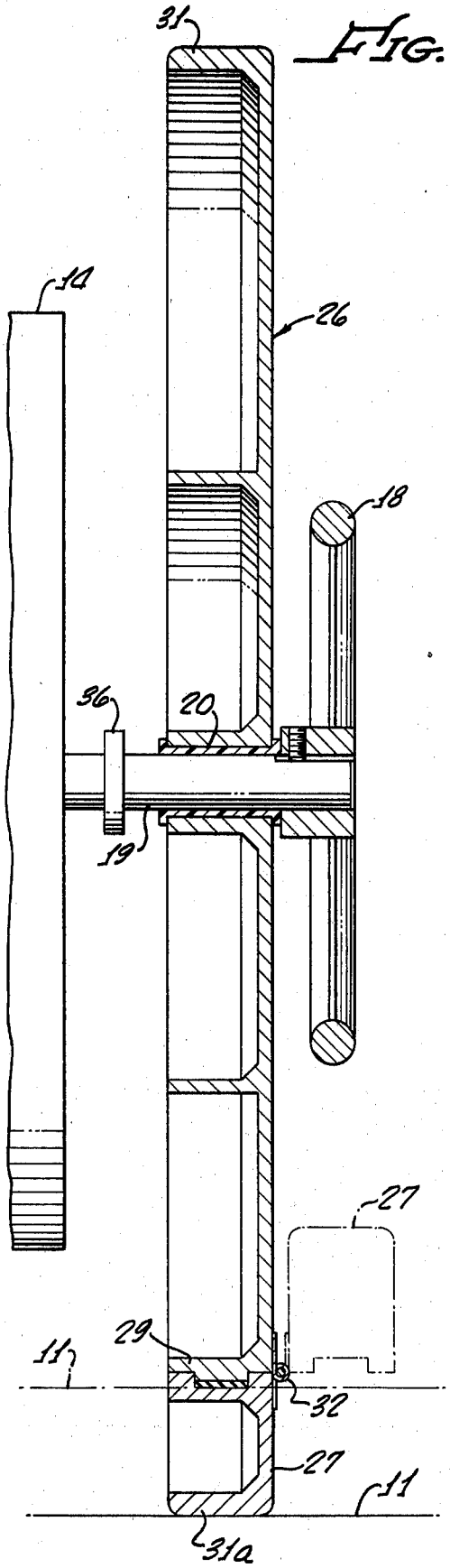
FIG. 6 is an enlarged transverse sectional view taken along line 6—6 of FIG. 5.
Figure 5:
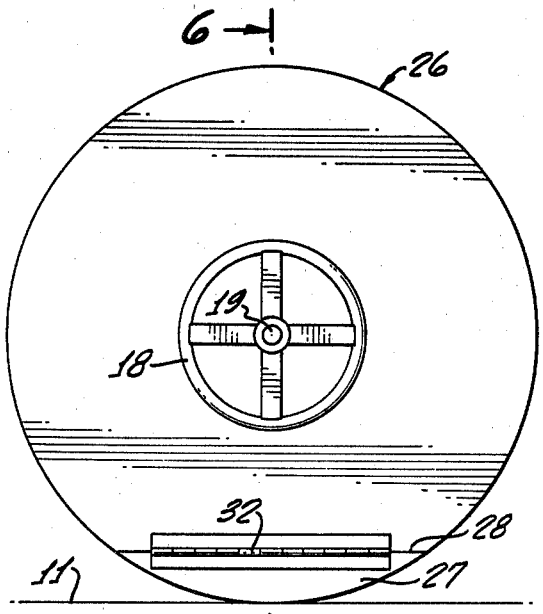
FIG. 5 is an end elevational view of a second embodiment of the pool-cover apparatus, showing such second embodiment in its rolling condition permitting transport of the reel back and forth to a storage area.
Figure 7:
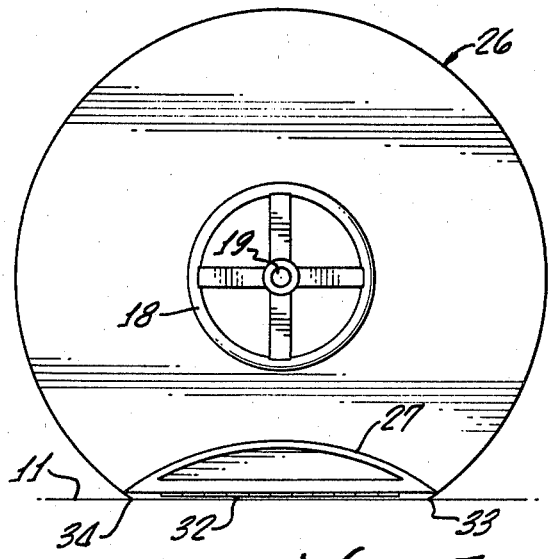
FIG. 7 is a view corresponding of FIG. 5 but showing the braked condition of the apparatus, such braked condition corresponding to that shown in phantom line in FIG. 6.

Embodiment of FIGS. 5–7

In the present embodiment, the pool cover 14, and the associated roller and the stub shafts 19 and hand wheels 18, are the same as in the previous embodiment. However, the end frames are different. Such end frames are mirror imgaes of each other, and only one, numbered 26, will be described.

Each end frame 26 is a wheel which is, preferably, coaxial with its associated stub shaft 19 and thus with the roller 13 associated with the stub shaft. Wheel 26 is large in diameter, larger than that of the rolled-up pool cover 14, and the entire wheel 26 is adapted to roll on decking 11 when it is desired to transport the apparatus to or from the pool. The rotation of the wheels which form end frames 26 is very free and easy.

One segment, numbered 27, of wheel-frame 26 is not integrally associated therewith but instead is separate and pivotally connected thereto. Stated more specifically, the main body of wheel 26 is not complete but terminates along a chord 28 at which there is an inwardly-extending flange 29. The chordal flange 29 (FIG. 6) extends to a generally circular flange 31, the latter extending around all portions of wheel 26 except at the segment 27. Segment 27 has a flange **31*a* which forms an extension of circular flange 31 when the apparatus is in the solid-line position of FIGS. 5 and 6. Thus, flanges 31 and 31*a* roll on decking 11** during transport of the entire apparatus.

Segment 27 is pivotally connected to the remainder of frame or wheel 26 at a hinge 32 which is illustrated as being a piano hinge. Hinge 32 is disposed longitudinally of the chord 28 (FIG. 5) on the side of the end frame remote from the rolled-up pool cover 14. Means, for example corresponding male and female portions of the end frames along chord 28, are provided to maintain segment 27 in its rolling position except when it is deliberately moved to a position 180 degrees away from such rolling position as shown in phantom lines in FIG. 6. When segment 27 is in this latter position, the chordal region of the end frame 26 rests on decking 11, and there is sufficient braking area that the end frames will not slide on the decking when the pool cover 14 is unrolled in order to cover the pool. The pivoted-up segment 27 aids in preventing rolling.

The method relative to the embodiment of FIGS. 5–7 is as follows. With each entire wheel 26 in rolling condition, as shown in solid lines in FIG. 6 and also in FIG. 5, the large wheels which form the end frames are employed to roll the entire reel apparatus to the position adjacent the end of the pool as described relative to the previous embodiment. Then, one of the frames (wheels) 26 is rotated until the segment 27 is not adjacent the decking 11. It is then a very simple matter for the operator to rotate segment 27 from the solid line position of FIG. 6 to the phantom-line position thereof. Then, such end frame (wheel) 26 is rolled and tilted back until the region along chord 28 engages decking 11 as shown in FIG. 7. There is thus provided, in a very simple manner, an effective braking action. During this rolling back to the position at which braking is achieved, there is some tilting or rocking of each frame at a corner region, namely one of the corners 33 and 34 shown in FIG. 5.

The same operation is then performed relative to the frame at the other end of the pool-cover. Then, pool cover 14 is unrolled by pulling on its end, as described relative to the previous embodiment. When it is desired to retrieve the cover, either one of the hand wheels 18 is turned to roll up the pool cover on its associated roller element (corresponding to roller 13 in the previous embodiment).

When it is desired to remove the entire apparatus to a storage area, each end frame (wheel) 26 is rotated, by tilting or rocking on either of the corners 33 or 34 (FIG. 7), until the chordal region along chord 28 is no longer adjacent decking 11. Stated more particularly, the rocking at corner 33 is followed immediately by rotation along the circular flange 31. Then, the segment 27 is pivoted back to a position where it forms a continuation of the wheel. The wheels are then in completely operative rolling condition, and the apparatus is readily pushed to the storage region.

Collars 36 are provided on the stub shafts 19 to make sure that the rollers and rolled-up pool cover 14 do not engage the end frames in either embodiment.

The end frames of both embodiments are, preferably, injection molded of a suitable synthetic resin.

The result of the described apparatus is a very economical, practical, lightweight apparatus which may be readily shifted to any desired region and braked at any desired region. There is no predetermined anchoring area, no unsightly braking apparatus, and no necessity of providing anchor means in the decking.

The foregoing detailed description is to be clearly understood as given by way of illustration and example only, the spirit and scope of this invention being limited solely by the appended claims.

What is claimed is:

1. A pool-cover apparatus which comprises:

(a) an elongated roller element adapted to have a flexible pool cover wrapper therearound, (b) first and second end frames, (c) means to rotatably connect the ends of said roller element to said respective end frames, and (d) first and second wheels rotatably mounted on each of said end frames at regions spaced from the regions of connection of said roller-element ends to said end frames said wheels being located and mounted in one surface of each of said frames so that the entire pool-cover apparatus may be pushed along the decking from a storage area to a location adjacent the pool, with only said wheels contacting the decking and rolling therealong, (e) each of said frames providing a second surface angularly spaced from said first surface whereby each of said frames may be manually tilted to a braking position at which said wheels are removed from engagement with the decking, and said second surface is engaged with said decking, said regions of connection of said roller-element ends to said end frames are so located that, when said frames are in their tilted braking positions, said roller element and pool cover may rotate freely so as to unwind said pool cover.

2. The invention as claimed in claim 1, in which crank means are connected to said roller element at at least one of said end frames, and are adapted to be manually rotated to roll up the pool cover on said roller element when said end frames are in their tilted braking positions.

3. The invention as claimed in claim 1, in which said end frames are so shaped that said second surfaces comprise large braking areas.

4. The invention as claimed in claim 1, in which each of said end frames is generally triangular, and lies in a plane perpendicular to the axis of said roller element, and in which said wheels on each frame are on said one surface which comprises only one side of the triangle, so that each frame may be tilted in either direction to provide said second surface placed into a braked relationship to the decking.

5. The invention as claimed in claim 4, in which each frame is a substantially solid equilateral triangle, and in which a flange is provided peripherally of the triangle, the wheels being mounted on the flange along one side of the triangle, providing said one surface, the flange portions along the remaining two sides of the triangle comprising each one said second surface.

6. A pool-cover apparatus which comprises:

(a) an elongated roller element adapted to have a flexible pool cover wrapped therearound, (b) first and second end frames, each of said end frames being a wheel connected coaxially and rotatably to one end of said roller element, the diameter of each wheel being greater than that of the wound-up pool cover, so that said wheels will roll along the decking when the apparatus is pushed from a storage area to a region adjacent the pool, and (c) brake means to prevent rotation of said wheels to thus hold the wheels and roller element in desired positions when the pool cover is being pulled out or wound up, said brake means being a peripheral portion of each wheel which is removable therefrom so that a region of the wheel periphery becomes non-arcuate and rests on the decking.

7. The invention as claimed in claim 6, in which said removable peripheral portion of each wheel is a segment thereof, and in which removal of the segment causes a large-area chordal wheel portion to rest on the decking.

8. The invention as claimed in claim 7, in which said wheel segment is hingedly connected to the wheel along one edge of the chord which in part defines said segment.

9. The invention as claimed in claim 6, in which crank means are connected to said roller element, being rotatably associated with at least one wheel at the axis thereof.

10. The invention as claimed in claim 6, in which said wheels are molded of synthetic resin.

11. A method of transporting pool-cover apparatus, and of covering and uncovering a pool, which method comprises:

(a) providing a pool-cover apparatus comprising an elongated roller element on which a flexible pool cover is wound, said apparatus further comprising end frames connected to the ends of said roller element, said end frames including one surface which incorporates wheel means, and a braking surface, (b) causing said wheel means to be fully operative and in engagement with the decking, (c) shifting the pool-cover apparatus from a storage area to a location adjacent the pool, by rolling said operative wheel means along the decking, (d) causing said wheel means to be inoperative by braking the same and locating said end frames in a position fixed with respect to the pool, said step (d) being effected by an operation which includes tilting of said end frames from said wheel means to said braking surface, and thus causing braking of said end frames against the decking, (e) unrolling and later rolling-up said pool cover while said end frames are thus braked, (f) again causing said wheel means to be fully operative, by an operation which includes tilting of said end frames, and (g) shifting the pool-cover apparatus back to the storage area, by rolling said operative wheel means along the decking.

12. The invention of claim 11, in which said method comprises providing end frames which have said wheel means in the form of two wheels mounted along one side thereof, and effecting said braking by tilting said end frames until said wheels are not in engagement with the decking.

13. The invention of claim 11, in which said method comprises providing end frames which are also large-diameter wheels, and effecting said braking by removing peripheral portions of said wheels while said peripheral portions are not adjacent the decking, and then effecting said tilting of said end frames so that the frame regions from which said peripheral wheel portions were removed are in engagement with the decking.

14. The invention of claim 13, in which said method further comprises causing said peripheral wheel portions to be segments of said wheels.

* * * * *